US007375153B2

(12) United States Patent
Goguen et al.

(10) Patent No.: US 7,375,153 B2
(45) Date of Patent: May 20, 2008

(54) ZINC STEARATE-CIS-TO-TRANS CATALYST BLENDS FOR IMPROVED GOLF BALL CORE COMPOSITIONS

(75) Inventors: Douglas S. Goguen, New Bedford, MA (US); Michael J. Sullivan, Barrington, RI (US); David A. Bulpett, Boston, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 225 days.

(21) Appl. No.: 11/111,507

(22) Filed: Apr. 21, 2005

(65) Prior Publication Data

US 2005/0187353 A1 Aug. 25, 2005

Related U.S. Application Data

(63) Continuation-in-part of application No. 10/854,538, filed on May 26, 2004, now Pat. No. 7,071,253, which is a continuation of application No. 10/237,954, filed on Sep. 9, 2002, now Pat. No. 6,762,247, which is a continuation-in-part of application No. 09/951,963, filed on Sep. 13, 2001, now Pat. No. 6,635,716.

(51) Int. Cl.
*A63B 37/06* (2006.01)
*A63B 37/00* (2006.01)

(52) U.S. Cl. ..... 524/394; 524/397; 524/399; 525/245; 525/261; 525/262; 525/274; 473/372; 473/373; 473/377

(58) Field of Classification Search ..... None
See application file for complete search history.

(56) References Cited

U.S. PATENT DOCUMENTS 5,334,673 A 8/1994 Wu
5,484,870 A 1/1996 Wu
5,733,428 A 3/1998 Calabria et al.
6,162,135 A 12/2000 Bulpett et al.
6,291,592 B1 9/2001 Bulpett et al.
6,458,895 B1 10/2002 Wrigley et al.
6,465,578 B1 10/2002 Bissonnette et al.
6,537,158 B2 3/2003 Watanabe
6,569,034 B2 5/2003 Dewanjee et al.
2002/0042311 A1 4/2002 Watanbe
2002/0045498 A1 4/2002 Watanbe
2002/0155906 A1 10/2002 Sullivan et al.
2002/0177492 A1 11/2002 Watanabe et al.
2003/0022733 A1 1/2003 Sullivan et al.
2003/0027666 A1 2/2003 Watanabe et al.
2003/0060307 A1 3/2003 Umezawa et al.
2003/0064826 A1* 4/2003 Voorheis et al. ..... 473/367
2003/0073516 A1 4/2003 Watanabe et al.
2003/0100383 A1 5/2003 Jordan
2003/0100386 A1 5/2003 Jordan
2003/0207999 A1* 11/2003 Higuchi et al. ..... 525/274
2005/0049367 A1 3/2005 Rajagopalan et al.
2006/0019771 A1* 1/2006 Kennedy et al. ..... 473/351

OTHER PUBLICATIONS

Thain, Science and Golf IV, 2002; pp. 319-327.*
Akzo Nobel product literature for Trigonox 42-40B.*

* cited by examiner

*Primary Examiner*—David J. Buttner
(74) *Attorney, Agent, or Firm*—William B. Lacy

(57) ABSTRACT

A golf ball including a solid core formed from a composition comprising a diene rubber, a metallic fatty acid salt present in an amount of from 6.3 parts to 7.5 parts, a cis-to-trans catalyst present in an amount of 2.35 parts or greater, and an organic peroxide present in an amount of 0.8 parts or less; and a cover; wherein the core has a coefficient of restitution of 0.810 or greater and a compression of 58 to 78.

16 Claims, 1 Drawing Sheet

ZINC STEARATE-CIS-TO-TRANS CATALYST BLENDS FOR IMPROVED GOLF BALL CORE COMPOSITIONS

CROSS-REFERENCE TO RELATED APPLICATIONS

This application is a continuation-in-part of U.S. patent application Ser. No. 10/854,538, filed May 26, 2004 and now U.S. Pat. No. 7,071,253, which is a continuation of U.S. patent application Ser. No. 10/237,954, filed Sep. 9, 2002 and now U.S. Pat. No. 6,762,247, which is a continuation-in-part of U.S. patent application Ser. No. 09/951,963, filed Sep. 13, 2001, now U.S. Pat. No. 6,635,716.

FIELD OF THE INVENTION

This invention relates generally to golf balls and, in particular, golf ball cores formed of a core composition including elevated levels of a metallic fatty acid, preferably zinc stearate, a cis-to-trans catalyst, and low levels of peroxide.

BACKGROUND

Golf balls can generally be divided into two classes: solid and wound. Solid golf balls include one-piece, two-piece (i.e., solid core and a cover), and multi-layer (i.e., solid core of one or more layers and/or a cover of one or more layers) golf balls. Wound golf balls typically include a solid, hollow, or fluid-filled center, encased in a layer of tensioned elastomeric material and a cover layer. Solid balls have traditionally been considered longer and more durable than wound balls, and, until recently, were considered to lack the particular "feel" that was provided by the wound construction and typically preferred by accomplished golfers.

By altering solid golf ball construction and the composition of the individual layers, however, manufacturers can vary a wide range of playing characteristics, such as resilience, durability, spin, and "feel," each of which can be optimized for various playing abilities, allowing solid golf balls to provide feel characteristics more like their wound predecessors.

The core is considered the 'engine' of the golf ball. Generally, golf ball cores constructed with a polybutadiene-based polymer composition. Compositions of this nature are constantly being tweaked in an effort to provide a targeted or desired coefficient of restitution, compression, spin rate, and/or "feel." This is a difficult task, however, given the physical limitations of currently-available polymers.

As such, there remains a need for improved golf ball core (and core layer) materials and/or blends. While metallic fatty acid salts, such as zinc stearate, have been used in golf ball formulations for many years, cis-to-trans conversion is relatively new. Higher levels of metallic fatty acid salts are generally considered to be detrimental (i.e., lower COR and compression). It has been determined, however, that golf ball core formulations comprising elevated levels of a metallic fatty acid salt, preferably zinc stearate, in combination with a cis-to-trans catalyst and low levels of peroxide, result in unexpected improvement in COR and compression, without the loss of both typically associated with the addition of high levels of metallic fatty acid salts.

SUMMARY OF THE INVENTION

The present invention is directed to a golf ball including a solid core formed from a composition comprising a diene rubber, a metallic fatty acid salt present in an amount of 6 parts or greater, a cis-to-trans catalyst, and an organic peroxide initiator present in an amount of 1.2 parts or less; and a cover.

Preferably, the initiator is present in an amount of 0.8 parts or less. The metallic fatty acid salt is typically formed from a fatty acid, such as stearic acid, lauric acid, behenic acid, erucic acid, oleic acid, linoleic acid, pelargonic acid, and dimerized derivatives thereof. The metallic fatty acid salt is preferably formed from a metal cation, such as barium, lithium, sodium, zinc, bismuth, chromium, cobalt, copper, potassium, strontium, titanium, tungsten, magnesium, cesium, iron, nickel, silver, aluminum, tin, and calcium. In a preferred embodiment, the metallic fatty acid salt is zinc stearate.

The metallic fatty acid salt is present in an amount of 6 to 12 parts per hundred, more preferably, 6.3 to 7.5 parts per hundred. The organic peroxide typically is dicumyl peroxide; 1,1-di(t-butylperoxy) 3,3,5-trimethyl cyclohexane; α,β-bis (t-butylperoxy) diisopropylbenzene; 2,5-dimethyl-2,5 di(t-butylperoxy) hexane; or di-t-butyl peroxide.

The cis-to-trans catalyst may include pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; ditolyl disulfide; diphenyl disulfide; or metal salts thereof.

Preferably, the cis-to-trans catalyst is present in an amount of 0.05 parts to 5 parts. In an alternative embodiment, the cis-to-trans catalyst is present in an amount of 2.3 parts to 5 parts. In a preferred embodiment, the cis-to-trans catalyst is pentachlorothiophenol or the metal salt thereof.

While the golf ball can have any construction, preferably the core has an outer diameter of 1.62 inches or less, more preferably 1.54 inches to 1.59 inches. The cover generally is formed from polyurethanes, polyureas, polyurea-urethanes, polyurethane-ureas, ionomeric materials, vinyl resins, polyolefins, polyamides, acrylic resins, thermoplastics, polyphenylene oxide resins, thermoplastic polyesters, thermoplastic rubbers, or fully-neutralized ionomers.

In one embodiment, the core includes a center and an outer core layer. The cover may also include an inner cover layer and an outer cover layer. When an inner cover is present, it is generally formed from an ionomeric material, vinyl resins, polyolefins, polyurethanes, polyureas, polyamides, acrylic resins, thermoplastics, polyphenylene oxide resins, thermoplastic polyesters, thermoplastic rubbers, fully-neutralized polymers, or fully-neutralized ionomers. A preferred core has a compression of 58 to 78 and a coefficient of restitution of 0.815 or greater.

The present invention is also directed to a golf ball including a solid core formed from a composition including a diene rubber, a metallic fatty acid salt present in an amount of from 6.3 parts to 7.5 parts, a cis-to-trans catalyst present in an amount of 2.35 parts or greater, and an organic peroxide present in an amount of 0.8 parts or less; and a cover; wherein the core has a coefficient of restitution of 0.810 or greater and a compression of 58 to 78.

DETAILED DESCRIPTION OF THE INVENTION

Figure 1:
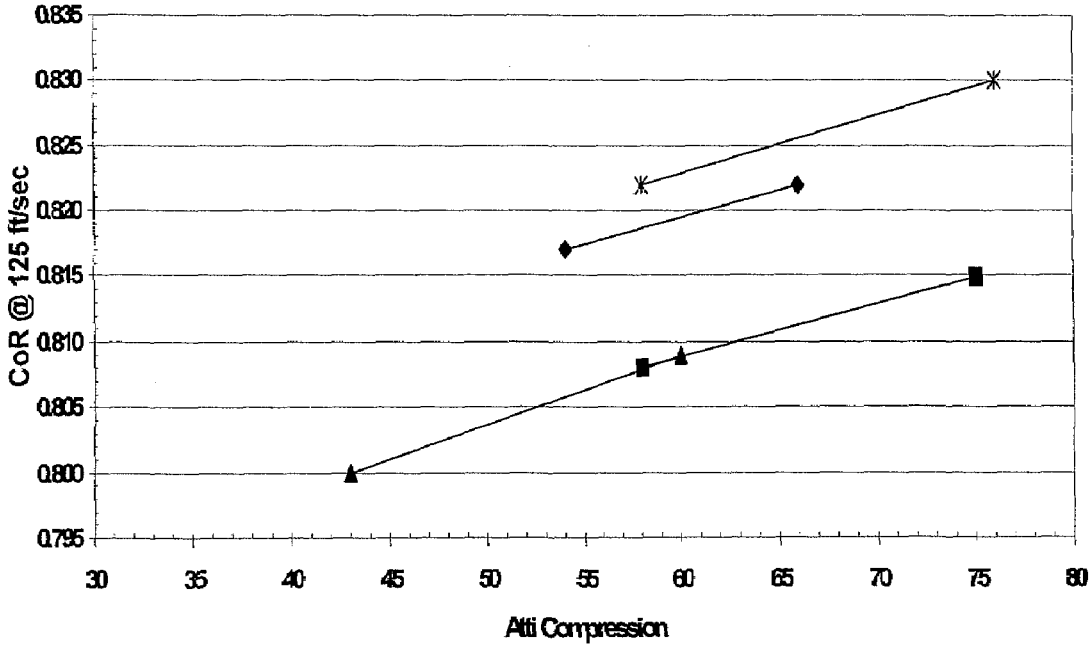
FIG. 1 is a plot of coefficient of restitution ("COR") v. Atti compression, showing the effect of increasing levels of metallic fatty acid salt and addition of cis-to-trans catalyst.

The golf balls of the present invention may comprise any of a variety of constructions but preferably includes a core and a cover surrounding the core. The core and/or the cover may have more than one layer and an intermediate layer may be disposed between the core and the cover of the golf ball. For example, the core of the golf ball may comprise a conventional center surrounded by an intermediate or outer core layer disposed between the center and the inner cover layer. The core may be a single layer or may comprise a plurality of layers. The innermost portion of the core may be solid or it may be a liquid filled sphere, but preferably it is solid. As with the core, the intermediate layer or outer core layer may also comprise a plurality of layers. The intermediate layer may also be a wound layer of a tensioned elastomeric material.

The solid cores of the present invention are formed from compositions comprising a base rubber, a crosslinking agent, a metallic fatty acid salt, an initiator, a cis-to-trans catalyst, and a filler. It is believed that the unique combination of a metallic fatty acid, relatively low levels of peroxide (the initiator), and a cis-to-trans catalyst shift the rheometer cure curves to shorter times, indicating an increased cure rate over conventional core formulations.

The base rubber typically includes natural or synthetic rubbers. A preferred base rubber is 1,4-polybutadiene having a cis-structure of at least 40%, more preferably at least about 90%, and most preferably at least about 95%. Preferably, the base rubber has a Mooney viscosity greater than about 35, more preferably greater than about 40. Preferably, the polybutadiene rubber has a molecular weight greater than about 250,000, more preferably greater than about 350,000, and a polydispersity of no greater than about 3, preferably no greater than about 2.5. Examples of desirable polybutadiene rubbers include BUNA® CB22 and BUNA® CB23, commercially available from Lanxess of Akron, Ohio.; UBEPOL® 360L and UBEPOL® 150L, commercially available from UBE Industries of Tokyo, Japan; and CARIFLEX® BCP820 and CARIFLEX® BCP824, commercially available from Shell of Houston, Tex. If desired, the polybutadiene can also be mixed with other elastomers known in the art such as natural rubber, polyisoprene rubber and/or styrene-butadiene rubber in order to modify the properties of the core.

The crosslinking agent includes a metal salt, such as a zinc salt or a magnesium salt of an α,β-unsaturated fatty acid, such as acrylic or methacrylic acid, having 3 to 8 carbon atoms. Examples include, but are not limited to, one or more metal salts of diacrylates, dimethacrylates, and monomethacrylates, wherein the metal is magnesium, calcium, zinc, aluminum, sodium, lithium, or nickel. Preferred acrylates include zinc acrylate, zinc diacrylate, zinc methacrylate, zinc dimethacrylate, and mixtures thereof. The crosslinking agent is typically present in an amount greater than about 10 pph based on 100 parts of the base polymer, preferably from about 15 to 40 pph of the base polymer, more preferably from about 18 to 35 pph of the base polymer.

The metallic fatty acid salts suitable for the cores of the present invention include those based on aliphatic mono- or multi-functional (saturated, unsaturated, or multi-unsaturated) organic acids. Preferred fatty acids include 4-32 carbon fatty acids (and their metal salts), such as stearic acid, lauric acid, behenic acid, erucic acid, oleic acid, linoleic acid, and pelargonic acid, or dimerized derivatives thereof. Preferably the fatty acid is stearic acid. The metal cations for the salts of organic acids of the present invention include barium, lithium, sodium, zinc, bismuth, chromium, cobalt, copper, potassium, strontium, titanium, tungsten, magnesium, cesium, iron, nickel, silver, aluminum, tin, or calcium. In a most preferred embodiment, the metal cation is zinc and the fatty acid is stearic acid.

The metallic fatty acid salt should be present in an amount greater than 5 pph, preferably from about 6 pph to about 20 pph, more preferably from about 6 pph to about 12 pph, most preferably from about 6.3 pph to about 7.5 pph.

It should be understood that although stearic acid is the common name for octadecanoic acid, commonly available zinc stearate (the zinc salt of octadecanoic acid) typically exists as a mixture, with as low as approximately 50% Zn octadecanoic (stearic) acid content, about 25-45% Zn hexadecanoic (palmitic) acid, and about 5-10% Zn octadecenoic (oleic) acid. All examples herein use the commonly available form. Purer grades, which are also suitable for the present invention, do exist and may be used interchangeably, adjusting for desired concentration of metallic fatty acid. Desired metallic fatty acid levels may be obtained by solution addition or by dry addition.

The initiator can be any known polymerization initiator which decomposes during the cure cycle. Suitable initiators include organic peroxide compounds, such as dicumyl peroxide; 1,1-di(t-butylperoxy) 3,3,5-trimethyl cyclohexane; α,α-bis (t-butylperoxy) diisopropylbenzene; 2,5-dimethyl-2,5 di(t-butylperoxy) hexane; di-t-butyl peroxide; and mixtures thereof. Other examples include, but are not limited to, VAROX® 231XL and VAROX® DCP-R, commercially available from Elf Atochem of Philadelphia, Pa.; PERKADOX® BC and PERKADOX® 14, commercially available from Akzo Nobel of Chicago, Ill.; and ELASTOCHEM® DCP-70, commercially available from Rhein Chemie of Trenton, N.J.

It is well known that peroxides are available in a variety of forms having different activity. The activity is typically defined by the "active oxygen content." For example, PERKADOX® BC peroxide is 98% active and has an active oxygen content of 5.80%, whereas PERKADOX® DCP-70 is 70% active and has an active oxygen content of 4.18%. Unlike conventional butadiene rubber blends, which typically require the presence of peroxide in amounts as great as 5 pph, if the peroxide is present in pure form, it is preferably present in an amount of less than about 1.2 pph, more preferably between about 0.35 pph and about 1.0 pph, and most preferably between about 0.5 pph and about 0.8 pph. Peroxides are also available in concentrate form, which are well-known to have differing activities, as described above. In this case, if concentrate peroxides are employed in the present invention, one skilled in the art would know that the concentrations suitable for pure peroxides are easily adjusted for concentrate peroxides by dividing by the activity. For example, 2 pph of a pure peroxide is equivalent 4 pph of a concentrate peroxide that is 50% active (i.e., 2 divided by 0.5=4).

The cis-to-trans catalyst is preferably a halogenated thiophenol and typically include, but are not limited to, those having the following general formula:

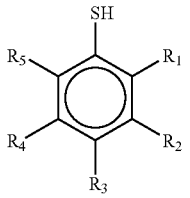

where $R_1$-$R_5$ can be $C_1$-$C_8$ alkyl groups; halogen groups; thiol groups (—SH), carboxylated groups; sulfonated groups; and hydrogen; in any order. At least one group is halogenated. Suitable examples include, but are not limited to, pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; 25 pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenoland; and their salts, preferably their zinc or magnesium salts. In a preferred embodiment, the halogenated thiophenol compound is pentachlorothiophenol, which is commercially available in neat form or under the tradename STRUKTOL®, a clay-based carrier containing the sulfur compound pentachlorothiophenol loaded at 45 percent (correlating to 2.4 parts PCTP). STRUKTOL® is commercially available from Struktol Company of America of Stow, Ohio. Pentachlorothiophenol is commercially available, in neat and salt forms, from eChinachem of San Francisco, Calif. Most preferably, the halogenated thiophenol compound is the zinc salt of pentachlorothiophenol, also available from eChinachem of San Francisco, Calif.

The cis-to-trans conversion compounds of the present invention can be present in any amount, typically about 0.05 pph to about 5 pph, but are preferably present in an amount greater than about 2.2 pph, more preferably between about 2.3 pph and about 5 pph, and most preferably between about 2.3 and about 4 pph.

The invention also includes a method to convert the cis-isomer of the polybutadiene resilient polymer component to the trans-isomer during a molding cycle and to form a golf ball. A variety of methods and materials suitable for cis-to-trans conversion have been disclosed in U.S. Pat. Nos. 6,162,135; 6,291,592; 6,465,578; and 6,458,895, the disclosures of which are incorporated herein, in their entirety, by reference. Specifically, ditolyl disulfide ("DTDS") or diphenyl disulfide ("DPDS") are preferred alternative cis-to-trans agents.

Fillers typically include materials such as tungsten, zinc oxide, barium sulfate, silica, calcium carbonate, zinc carbonate, metals, metal oxides and salts, regrind (recycled core material typically ground to about 30 mesh particle), high-Mooney-viscosity rubber regrind, and the like. Fillers added to one or more portions of the golf ball typically include processing aids or compounds to affect rheological and mixing properties, density-modifying fillers, tear strength, or reinforcement fillers, and the like. The fillers are generally inorganic, and suitable fillers include numerous metals or metal oxides, such as zinc oxide and tin oxide, as well as barium sulfate, zinc sulfate, calcium carbonate, barium carbonate, clay, tungsten, tungsten carbide, an array of silicas, and mixtures thereof. Fillers may also include various foaming agents or blowing agents which may be readily selected by one of ordinary skill in the art. Fillers may include polymeric, ceramic, metal, lipid-based nanotubules, and glass microspheres, and may be solid or hollow, and filled or unfilled. Fillers are typically also added to one or more portions of the golf ball to modify the density thereof to conform to uniform golf ball standards. Fillers may also be used to modify the weight of the center or at least one additional layer.

The materials used in forming either the golf ball center or any portion of the core, in accordance with the invention, may be combined to form a mixture by any type of mixing known to one of ordinary skill in the art. Suitable types of mixing include single pass and multi-pass mixing. Suitable mixing equipment is well known to those of ordinary skill in the art, and such equipment may include a Banbury mixer, a two-roll mill, or a twin screw extruder.

Conventional mixing speeds for combining polymers are typically used. The mixing temperature depends upon the type of polymer components, and more importantly, on the type of free-radical initiator. Suitable mixing speeds and temperatures are well-known to those of ordinary skill in the art, or may be readily determined without undue experimentation.

The mixture can be subjected to, e.g., a compression or injection molding process, to obtain solid spheres for the center or hemispherical shells for forming an intermediate layer. The temperature and duration of the molding cycle are selected based upon reactivity of the mixture. The molding cycle may have a single step of molding the mixture at a single temperature for a fixed time duration. The molding cycle may also include a two-step process, in which the polymer mixture is held in the mold at an initial temperature for an initial duration of time, followed by holding at a second, typically higher temperature for a second duration of time. In a preferred embodiment of the current invention, a single-step cure cycle is employed. The materials used in forming either the golf ball center or any portion of the core, in accordance with the invention, may be combined to form a golf ball by an injection molding process, which is also well-known to one of ordinary skill in the art. Although the curing time depends on the various materials selected, those of ordinary skill in the art will be readily able to adjust the curing time upward or downward based on the particular materials used and the discussion herein.

Properties that are desirable for the cover include good moldability, high abrasion resistance, high tear strength, high resilience, and good mold release. The cover typically has a thickness to provide sufficient strength, good performance characteristics, and durability. The cover preferably has a thickness of less than about 0.1 inches, more preferably, less than about 0.05 inches, and most preferably, between about 0.02 inches and about 0.04 inches. The invention is particularly directed towards a multilayer golf ball which comprises a core, an inner cover layer, and an outer cover layer. In this embodiment, preferably, at least one of the inner and outer cover layer has a thickness of less than about 0.05 inches, more preferably between about 0.02 inches and about 0.04 inches. Most preferably, the thickness of either layer is about 0.03 inches.

When the golf ball of the present invention includes an inner cover layer, this layer can include any materials known to those of ordinary skill in the art, including thermoplastic and thermosetting material, but preferably the inner cover can include any suitable materials, such as ionic copolymers of ethylene and an unsaturated monocarboxylic acid which are available under the trademark SURLYN® of E.I. DuPont de Nemours & Co., of Wilmington, Del., or IOTEK® or ESCOR® of Exxon. These are copolymers or terpolymers of ethylene and methacrylic acid or acrylic acid partially neutralized with salts of zinc, sodium, lithium, magnesium, potassium, calcium, manganese, nickel or the like, in which the salts are the reaction product of an olefin having from 2 to 8 carbon atoms and an unsaturated monocarboxylic acid having 3 to 8 carbon atoms. The carboxylic acid groups of the copolymer may be totally or partially neutralized and might include methacrylic, crotonic, maleic, fumaric or itaconic acid.

The golf ball may include cover and/or core layers formed from any materials known to those of ordinary skill in the art, preferably thermoplastic and thermosetting materials. For example, intermediate and cover layers are preferably formed from polyureas, polyurethanes, or ionomers. However, other thermoplastic materials are also suitable. The intermediate and/or cover layers may also likewise include one or more homopolymeric or copolymeric materials, such as: (1) Vinyl resins, such as those formed by the polymerization of vinyl chloride, or by the copolymerization of vinyl chloride with vinyl acetate, acrylic esters, or vinylidene chloride; (2) Polyolefins, such as polyethylene, polypropylene, polybutylene, and copolymers such as ethylene methylacrylate, ethylene ethylacrylate, ethylene vinyl acetate, ethylene methacrylic or ethylene acrylic acid, propylene acrylic acid, and copolymers and homopolymers produced using a single-site catalyst or a metallocene catalyst; (3) Polyurethanes, such as those disclosed in U.S. Pat. No. 5,334,673; (4) Polyureas, such as those disclosed in U.S. Pat. No. 5,484,870; (5) Polyamides, such as those prepared from diamines and dibasic acids, as well as those from amino acids; (6) Acrylic resins; (7) Thermoplastics; olefinic thermoplastic rubbers; block copolymers of styrene and butadiene, isoprene, or ethylene-butylene rubber; or copoly (ether-amide); (8) Polyphenylene oxide resins or blends of polyphenylene oxide with high impact polystyrenes; (9) Thermoplastic polyesters, such as polyethylene terephthalate, polybutylene terephthalate, and polyethylene terephthalate/glycol modified; (10) Blends and alloys, including polycarbonate with acrylonitrile butadiene styrene, polybutylene terephthalate, polyethylene terephthalate, styrene maleic anhydride, polyethylene, elastomers, and the like, and polyvinyl chloride with acrylonitrile butadiene styrene or ethylene vinyl acetate or other elastomers; and (11) Blends of thermoplastic rubbers with polyethylene, propylene, polyacetal, nylon, polyesters, cellulose esters, and the like.

Any of the inner or outer cover layers may also be formed from polymers containing α,β-unsaturated carboxylic acid groups, or the salts thereof, that have been 100 percent neutralized by organic fatty acids. The acid moieties of the highly-neutralized polymers, typically ethylene-based ionomers, are preferably neutralized greater than about 70%, more preferably greater than about 90%, and most preferably at least about 100%. Suitable HNP materials are described in co-pending U.S. Patent Application Publication No. 2005/0049367 and U.S. patent application Ser. No. 10/959,751, filed Oct. 6, 2004, both of which are incorporated herein, in their entirety.

In a particularly preferred embodiment of the present invention, saturated polyurethanes used to form outer cover layers, preferably the outer cover layer, and may be selected from among both castable thermoset and thermoplastic polyurethanes. In this embodiment, the saturated polyurethanes are substantially free of aromatic groups or moieties.

Suitable methods for forming the intermediate and cover layers of the present invention include compression molding, injection molding, reaction injection molding, and liquid injection molding, all of which are known to one of ordinary skill in the art. It has been found by the present invention that the use of a castable, reactive material, which is applied in a fluid form, makes it possible to obtain very thin outer cover layers on golf balls. Specifically, it has been found that castable, reactive liquids, which react to form a urethane elastomer material, provide desirable very thin outer cover layers. The castable, reactive liquid employed to form the urethane and urea elastomer materials can be applied over the core using a variety of application techniques such as spraying, dipping, spin coating, or flow coating methods which are well known in the art. An example of a suitable coating technique is that which is disclosed in U.S. Pat. No. 5,733,428, the disclosure of which is hereby incorporated by reference in its entirety in the present application.

The resultant golf balls typically have a coefficient of restitution of greater than about 0.7, preferably greater than about 0.75, more preferably greater than about 0.78; and most preferably greater than about 0.810. The golf balls also typically have an Atti compression of at least about 40, preferably from about 50 to 120, and more preferably from about 60 to 100. The cured polybutadiene material of the golf ball cores typically has a hardness of at least about 15 Shore A, preferably between about 30 Shore A and 80 Shore D, more preferably between about 50 Shore A and 60 Shore D.

When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi. As discussed herein, the outer cover layer is preferably formed from a relatively soft polyurethane material. In particular, the material of the outer cover layer should have a material hardness, as measured by ASTM-D2240, less than about 60 Shore D, preferably less than about 45 Shore D, more preferably between about 25 and about 48 Shore D, and most preferably between about 30 and about 40 Shore D. The casing preferably has a material hardness of less than about 80 Shore D, more preferably between about 30 and about 75 Shore D, and most preferably, between about 50 and about 70 Shore D.

Alternatively, for a single cover layer golf ball or a thermoplastic outer cover layer in a multi-layer golf ball, the outermost layer may have a material hardness of 45 to 75 Shore D, more preferably 50 to 65 Shore D.

It should be understood, especially to one of ordinary skill in the art, that there is a fundamental difference between "material hardness" and "hardness, as measured directly on a golf ball." Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other.

The core of the present invention has an Atti compression of less than about 110, more preferably, between about 40 and about 100, and most preferably, between about 50 and about 90. In one embodiment, the core has a compression of between about 58 and about 78. In an alternative, low compression embodiment, the core has a compression less than about 20, more preferably less than about 10. The cores have a coefficient of restitution of greater than about 0.8, preferably greater than about 0.815, more preferably greater than about 0.820; and most preferably greater than about 0.822.

The overall outer diameter ("OD") of the core is less than about 1.62 inches, preferably, no greater than 1.61 inches, more preferably between about 1.54 inches and about 1.59 inches, and most preferably between about 1.5 inches and about 1.58 inches. The OD of the casing of the golf balls of the present invention is preferably between 1.58 inches and about 1.65 inches, more preferably between about 1.59 inches and about 1.64 inches, and most preferably between about 1.60 inches and about 1.63 inches.

The present multilayer golf ball can have an overall diameter of any size. Although United States Golf Association specifications limit the minimum size of a competition golf ball to a minimum of 1.680 inches, there is no specification as to the maximum diameter. Golf balls of any size, however, can be used for recreational play. The preferred diameter of the present golf balls is from about 1.680 inches to about 1.800 inches. The more preferred diameter is from about 1.680 inches to about 1.760 inches. The most preferred diameter is about 1.680 inches to about 1.740 inches.

EXAMPLE

The following non-limiting example depicts the unexpected improvement afforded by the present invention. Eight golf ball cores were made according to Table I below. Four of the cores (1a-b and 2a-b) contained a cis-to-trans catalyst (the zinc salt of pentachlorothiophenol)—two of the cores had lower levels of zinc stearate (1a-b) and two of the cores had high levels of zinc stearate (2a-b), per the present invention. Another four of the cores (3a-b and 4a-b) were void of a cis-to-trans catalyst—two of the four cores had low levels of zinc stearate (3a-b) and two of these cores had increased levels of zinc stearate (4a-b).

TABLE I

| | Core No. | | | |
|---|---|---|---|---|
| | 1a | 1b | 2a | 2b |
| Formulation | | | | |
| Buna CB23 | 100 | 100 | 100 | 100 |
| ZnO | 5 | 5 | 5 | 5 |
| Perkadox BC | 0.8 | 0.8 | 0.8 | 0.8 |
| Color dispersion | 0.14 | 0.14 | 0.14 | 0.14 |
| ZnPCTP | 2.35 | 2.35 | 2.35 | 2.35 |
| active ZDA * | 29.4 | 35.0 | 25.6 | 29.6 |
| active Zn stearate | 2.6 | 3.0 | 6.4 | 7.4 |
| Properties | | | | |
| Compression | 54 | 66 | 58 | 76 |
| COR (at 125 ft/s) | 0.817 | 0.822 | 0.822 | 0.830 |

| | Core No. | | | |
|---|---|---|---|---|
| | 3a | 3b | 4a | 4b |
| Formulation | | | | |
| Buna CB23 | 100 | 100 | 100 | 100 |
| ZnO | 5 | 5 | 5 | 5 |
| Trigonox 265 | 0.53 | 0.53 | 0.53 | 0.53 |
| Color dispersion | 0.14 | 0.14 | 0.14 | 0.14 |
| ZnPCTP | 0 | 0 | 0 | 0 |
| active ZDA * | 22.1 | 25.8 | 19.2 | 22.4 |
| active Zn stearate | 1.9 | 2.2 | 4.8 | 5.6 |
| Properties | | | | |
| Compression | 58 | 75 | 43 | 60 |
| COR (at 125 ft/s) | 0.808 | 0.815 | 0.800 | 0.809 |

* "active" is the undiluted form of ZDA or zinc stearate

A plot of the COR versus the Atti compression for the four groups of cores is presented in FIG. 1.

The non-cis-to-trans catalyst Control core (3a-b, ■) is located in the bottom, right-hand portion of the plot. Upon addition of elevated levels of zinc stearate (4a-b, ▲), as expected, the core properties dramatically shift in the soft and slow direction (decreased compression and COR). Not surprisingly, upon addition of ZnPCTP to the Control (1a-b, ♦), the core shifts substantially in the fast direction while becoming subtly softer. Surprisingly, upon the addition of high levels of zinc stearate to the cis-to-trans Control core formulation (2a-b, *), according to the present invention, the core properties do not shift in the slow/soft direction, as one would predict—they shift in an even faster direction (higher COR).

As used herein, the term "about," used in connection with one or more numbers or numerical ranges, should be understood to refer to all such numbers, including all numbers in a range.

Other than in the operating examples, or unless otherwise expressly specified, all of the numerical ranges, amounts, values and percentages, such as those for amounts of materials and others, in the following portion of the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball comprising:

a solid core having an Atti compression, the core being formed from a composition comprising a diene rubber, a metallic fatty acid salt present in an amount of 6.3 to 7.5 per hundred parts diene rubber such that the compression increases by 4 to 10 points, a cis-to-trans catalyst, and an organic peroxide initiator present in an amount of 1.2 parts per hundred parts diene rubber or less; and a cover comprising a polyurea that consists essentially of urea linkages.

2. The golf ball of claim 1, wherein the initiator is present in an amount of 0.8 parts per hundred parts diene rubber or less.

3. The golf ball of claim 1, wherein the metallic fatty acid salt is formed from a fatty acid selected from the group consisting of stearic acid, lauric acid, behenic acid, erucic acid, oleic acid, linoleic acid, pelargonic acid, and dimerized derivatives thereof.

4. The golf ball of claim 1, wherein the metallic fatty acid salt is formed from a metal cation selected from the group consisting of barium, lithium, sodium, zinc, bismuth, chromium, cobalt, copper, potassium, strontium, titanium, tungsten, magnesium, cesium, iron, nickel, silver, aluminum, tin, and calcium.

5. The golf ball of claim 1, wherein the metallic fatty acid salt comprises zinc stearate.

6. The golf ball of claim 1, wherein the cover comprises an inner cover layer and an outer cover layer.

7. The golf ball of claim 6, wherein the inner cover layer comprises an ionomeric material, vinyl resins, polyolefins, polyurethanes, polyureas, polyamides, acrylic resins, thermoplastics, polyphenylene oxide resins, thermoplastic polyesters, thermoplastic rubbers, fully-neutralized polymers, or fully-neutralized ionomers.

8. The golf ball of claim 1, wherein the initiator comprises dicumyl peroxide; 1,1-di(t-butylperoxy) 3,3,5-trimethyl cyclohexane; α,α-bis (t-butylperoxy) diisopropylbenzene; 2,5-dimethyl-2,5 di(t-butylperoxy) hexane; or di-t-butyl peroxide.

9. The golf ball of claim 1, wherein the cis-to-trans catalyst comprises pentafluorothiophenol; 2-fluorothiophenol; 3-fluorothiophenol; 4-fluorothiophenol; 2,3-fluorothiophenol; 2,4-fluorothiophenol; 3,4-fluorothiophenol; 3,5-fluorothiophenol 2,3,4-fluorothiophenol; 3,4,5-fluorothiophenol; 2,3,4,5-tetrafluorothiophenol; 2,3,5,6-tetrafluorothiophenol; 4-chlorotetrafluorothiophenol; pentachlorothiophenol; 2-chlorothiophenol; 3-chlorothiophenol; 4-chlorothiophenol; 2,3-chlorothiophenol; 2,4-chlorothiophenol; 3,4-chlorothiophenol; 3,5-chlorothiophenol; 2,3,4-chlorothiophenol; 3,4,5-chlorothiophenol; 2,3,4,5-tetrachlorothiophenol; 2,3,5,6-tetrachlorothiophenol; pentabromothiophenol; 2-bromothiophenol; 3-bromothiophenol; 4-bromothiophenol; 2,3-bromothiophenol; 2,4-bromothiophenol; 3,4-bromothiophenol; 3,5-bromothiophenol; 2,3,4-bromothiophenol; 3,4,5-bromothiophenol; 2,3,4,5-tetrabromothiophenol; 2,3,5,6-tetrabromothiophenol; pentaiodothiophenol; 2-iodothiophenol; 3-iodothiophenol; 4-iodothiophenol; 2,3-iodothiophenol; 2,4-iodothiophenol; 3,4-iodothiophenol; 3,5-iodothiophenol; 2,3,4-iodothiophenol; 3,4,5-iodothiophenol; 2,3,4,5-tetraiodothiophenol; 2,3,5,6-tetraiodothiophenol and; ditolyl disulfide; diphenyl disulfide; or metal salts thereof.

10. The golf ball of claim 1, wherein the cis-to-trans catalyst is present in an amount of 0.05 parts per hundred parts diene rubber to 5 parts per hundred parts diene rubber.

11. The golf ball of claim 10, wherein the cis-to-trans catalyst is present in an amount of 2.3 parts per hundred parts diene rubber to 5 parts per hundred parts diene rubber.

12. The golf ball of claim 1, wherein the cis-to-trans catalyst comprises pentachlorothiophenol or the metal salt thereof.

13. The golf ball of claim 1, wherein the core has an outer diameter of 1.62 inches or less.

14. The golf ball of claim 13, wherein the core has an outer diameter of 1.54 inches to 1.59 inches.

15. The golf ball of claim 1, wherein the core comprises a center and an outer core layer.

16. The golf ball of claim 1, wherein the core has a compression of 58 to 78 and a coefficient of restitution of 0.815 or greater.

* * * * *